US007985105B2

(12) United States Patent
Balsells

(10) Patent No.: US 7,985,105 B2
(45) Date of Patent: Jul. 26, 2011

(54) MULTILAYER WAVE SPRINGS WITH DIFFERENT PROPERTIES

(75) Inventor: Pete Balsells, Foothill Ranch, CA (US)

(73) Assignee: Bal Seal Engineering, Inc., Foothill Ranch, CA (US)

( * ) Notice: Subject to any disclaimer, the term of this patent is extended or adjusted under 35 U.S.C. 154(b) by 0 days.

(21) Appl. No.: 12/770,558

(22) Filed: Apr. 29, 2010

(65) Prior Publication Data

US 2010/0279557 A1 Nov. 4, 2010

Related U.S. Application Data

(60) Provisional application No. 61/174,599, filed on May 1, 2009.

(51) Int. Cl.
*H01R 4/48* (2006.01)

(52) U.S. Cl. ..... 439/816; 439/843

(58) Field of Classification Search ..... 439/816, 439/843, 825, 851

See application file for complete search history.

(56) References Cited

U.S. PATENT DOCUMENTS

| | | | | |
|---|---|---|---|---|
| 4,662,706 | A * | 5/1987 | Foley | 439/851 |
| 5,083,927 | A * | 1/1992 | Herard et al. | 439/80 |
| 5,653,615 | A * | 8/1997 | Inaba et al. | 439/827 |
| 6,254,439 | B1 * | 7/2001 | Endo et al. | 439/843 |
| 6,266,253 | B1 * | 7/2001 | Kurrer et al. | 361/796 |
| 6,875,063 | B2 * | 4/2005 | Zhao et al. | 439/851 |
| 7,387,548 | B2 * | 6/2008 | Takehara et al. | 439/843 |
| 7,462,078 | B2 * | 12/2008 | Mao | 439/843 |
| 7,520,787 | B2 * | 4/2009 | Waltz et al. | 439/816 |
| 2007/0123084 | A1 * | 5/2007 | Takehara et al. | 439/268 |

* cited by examiner

*Primary Examiner* — Hae Moon Hyeon

(74) *Attorney, Agent, or Firm* — Klein, O'Neill & Singh, LLP

(57) ABSTRACT

A circular or plate wave spring that maintains high conductivity under high operating temperatures is provided herein. This is possible due to, at least in part, the conductor being made from a bi-metallic or multi-metallic material which can include a high tensile strength material, such as steel, that maintains strength properties at elevated temperatures cladded with a layer of highly conductive metal, such as copper. The high tensile strength material helps maintain the contact force needed for good conductivity since highly conductive metals and alloys tend to lose their tensile properties at elevated temperatures. The connector is presented here as a wave spring providing inward or outward protrusions for a conductive pin and housing.

20 Claims, 4 Drawing Sheets

MULTILAYER WAVE SPRINGS WITH DIFFERENT PROPERTIES

CROSS-REFERENCE TO RELATED APPLICATION

This is a regular utility application of provisional Ser. No. 61/174,599, filed May 1, 2009, the contents of which are expressly incorporated herein by reference.

FIELD

Embodiments of the present application pertain to circular or disc-shaped electrical conductors as well as other shaped conductors having improved spring force. More particularly, embodiments of the present application are directed to circular wave springs, disc-shaped wave springs, and plate wave springs, also referred to as single turn wave springs. Features of the wave springs include bi-metallic configuration for high temperature and conductivity applications, such as for high temperature electrical connectors and switchgears.

BACKGROUND

Conventional wave or split springs used for electrical contacts are typically made from copper or copper alloys to achieve high conductivity. In addition to selecting suitable materials, another factor in achieving and maintaining adequate conductivity is the loading force of the spring contact on the contacting part.

Under high operating temperatures or in high current applications, copper or copper alloys may lose their physical properties and fail to provide the appropriate spring force required to maintain conductivity between parts. As such, it is desirable to provide wave springs for different applications that require high conductivity and corresponding appropriate spring force at different temperatures, including at elevated temperatures.

SUMMARY

Embodiments discussed herein include circular springs with internal/external waves that provide high conductivity under high temperature conditions.

Embodiments discussed herein also include a spring wave that provides high conductivity by using a conductive clad material having high conductivity and low modulus of elasticity supported by a high modulus metal, such as steel or stainless steel. By combining the high conductivity with high strength, which permits operating at high temperatures, required spring contact loads can be maintained.

Examples also include a combination of bimetallic or multi-metallic circular wave springs that provide conductivity as well as high tensile properties to be able to withstand high temperatures while providing high conductivity.

An additional example includes a longitudinal wave spring with clad conductive surfaces and encased high modulus surfaces that upon loading maintain the mechanical properties at elevated temperatures.

Another exemplary embodiment includes a method for providing a conductive wave spring capable of retaining its mechanical strength or integrity, such as resisting yielding or hot flow due to elevated temperatures. The method comprising a body section comprising a first layer having a first conductive property and a first tensile strength property and a second layer having a second conductive property and a second tensile strength property. Wherein the body section comprises at least two slits and a protrusion formed between the two slits and wherein the second conductive property is higher than the first conductive property.

Yet another exemplary embodiment of the present application is a wave spring configured for use in conductive applications that include elevated temperatures. The assembly comprises a body section comprising a first layer having a first conductive property and a first tensile strength property and a second layer having a second conductive property and a second tensile strength property, wherein the body section comprises at least two slits and a protrusion formed between the two slits; and wherein the second conductive property is higher than the first conductive property.

Still yet another exemplary embodiment of the present application is a wave spring comprising a body section comprising a first layer having a first conductive property and a first tensile strength property and a second layer having a second conductive property and a second tensile strength property, wherein the body section comprises at least two protrusions each formed between two parallel slits; and wherein the second tensile strength property is lower than the first tensile strength property.

BRIEF DESCRIPTION OF DRAWINGS

The various wave spring embodiments and associated methods now will be discussed in detail with an emphasis on highlighting the advantageous features. These embodiments depict the novel and non-obvious wave springs shown in the accompanying drawings, which are for illustrative purposes only. These drawings include the following figures, in which like numerals indicate like parts:

FIG. 3A is a cross-sectional end view of the wave spring of FIG. 3B taken along line E-E.

DETAILED DESCRIPTION

Figure 1A:
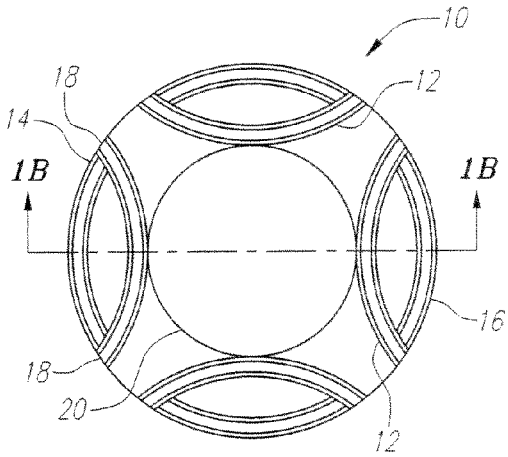
FIG. 1A shows a cross-sectional view of a wave spring comprising a plurality of internal radial protrusions with slits that permit the forming of the inwardly extending protrusions so that upon passing a pin through an inside diameter defined by the collective protrusions, the interference creates a radially outward force that causes a deflection of the wave spring.

The following detailed description describes the present embodiments with reference to the drawings. In the drawings, reference numbers label elements of the present embodiments. These reference numbers are reproduced below in connection with the discussion of the corresponding drawing features.

The detailed description in connection with the appended drawings is intended as a description of the presently preferred embodiments of wave springs. The wave springs provided herein are not intended to represent the only forms in which they may be constructed or used. The description sets forth the features and the steps for constructing and using aspects of the wave spring in connection with the illustrated embodiments. It is to be understood that the same or equivalent functions and structures may be accomplished by different embodiments and are also intended to be encompassed within the spirit and scope of the present invention, especially those incorporating a combination of features shown in the different embodiments included herein.

FIG. 1A shows a cross-sectional end view of a circular spring 10 with internal spring waves 12 extending internally of a generally cylindrical housing 14 comprising a housing wall 16. The circular spring 10 consists of axial slits 18 to allow formation of the spring waves 12, which consist of deforming a wall section of the cylindrical housing 14 defined by a pair of slits 18 inwardly to form the inwardly extending internal spring wave 12. Unless the context indicates otherwise, the internal spring wave 12 may be referred to simply as wave or protrusion. When the word "internal" or "external" precedes the word "wave" or "protrusion", it clarifies the wave as a wave that extends internally or externally. The peaks or apexes of the inward waves 12 define an imaginary circle 20 of a first dimension configured to receive a pin (not shown) of a second dimension, which is greater than the first dimension. The relative dimensions create an interference that in turn pushes the spring waves 12 upon assembly to create an outwardly bias. In one embodiment, the pin (not shown) is part of a male connector and the circular spring 10 is part of a connector housing. Electrical communication passes between the pin (not shown) and the circular spring, which are connected to respective nodes or electrical sources, such as to a battery terminal and to a starter, via cables or the likes (not shown).

In one embodiment, the circular spring 10 is formed by taking a generally cylindrical tube or housing 14, preferably of a conductive material, and creating a plurality of slits 18. The slits are formed in pairs with each pair configured to form an inwardly extending wave 12. As shown, the circular spring 10 comprises four pairs of slits 18 for forming four inwardly extending waves 12. However, more than or fewer than four pairs of slits may be incorporated without deviating from the spirit and scope of the present invention.

In another example, the pair of slits are deformed outwardly, i.e., away from the center of the housing 14, to create outward waves or protrusions, as further discussed below. In the outwardly extending wave spring embodiment, the housing defines a first nominal diameter whereas the apexes of the outwardly extending waves 12 define a second larger diameter, which is larger than the first nominal diameter.

Figure 1C:
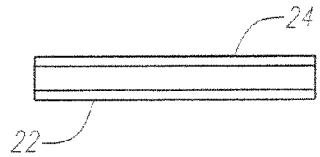
FIG. 1C shows a sectional view of FIG. 1B taken along line B-B, which shows a section of a metal strip in a rectangular form as provided in accordance with a first alternative embodiment.
Figure 1D:
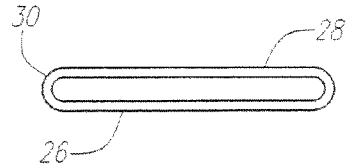
FIG. 1D shows a sectional view of FIG. 1B taken along line B-B, which shows a section of a metal strip as provided in accordance with a second alternative embodiment, which shows the ends of the metallic strip with rounded edges.
Figure 1B:
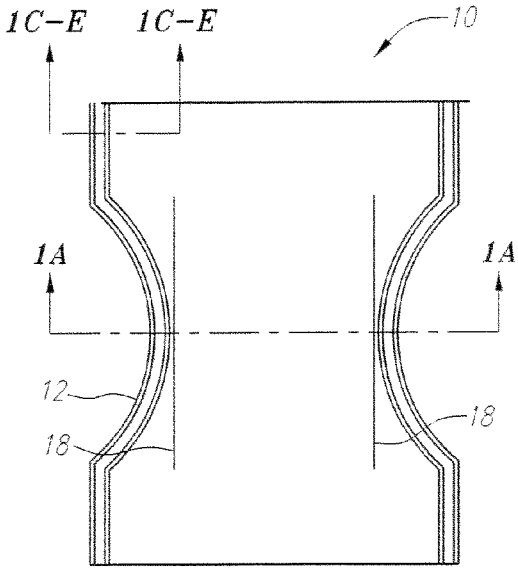
FIG. 1B shows a sectional view of FIG. 1A taken along line A-A, which shows the inwardly extending internal protrusions.

FIG. 1B shows a sectional view of the circular spring 10 showing internal protrusions 12 and axial slits 18 for forming the protrusions. Each pair of axial slits 18 (i.e., each set of two slits 18) may be spaced apart from one another by a distance that determines the width of the protrusion 12 along an orthogonal direction, which is understood to mean orthogonal to the axis of the housing shown with the notation "℄".. The length of each pair of axial slits 18 determines the length of each projection along an axial direction, which is understood to mean along the same direction as the axis of the housing. In one exemplary embodiment, each pair of slits has a width that determines an orthogonal width of about 15 degrees to about 135 degrees of an arc circle of the housing depending on the number of pairs incorporated in the circular spring 10. In a four-protrusion wave spring application, the orthogonal width of each protrusion or wave 12 is about 15 degrees to about 60 degrees of an arc circle. In one exemplary embodiment, each pair of slits has a length that is about 60% to about 200% of the length of the orthogonal width of a protrusion. Thus, an aspect of the present assembly and method is a generally cylindrical housing comprising a plurality of pair of slits for deforming to form waves, projections, or protrusions extending from the housing wall. In one example, the waves, projections, or protrusions extend outwardly and away from the housing axis. In another example, the waves extend inwardly toward the housing axis. In another example, the housing comprises two open ends for receiving a pin. In still yet another example, the apexes of the waves define an internal wave diameter for receiving the pin and biasing against the pin.

FIG. 1C shows a cross section of FIG. 1B taken along line B-B, which shows a clad material consisting of a high modulus base metal 22 and a conductive clad metal surface layer 24 that faces the imaginary circle 20 and having a square corner. In another embodiment, the high tensile strength material faces and/or forms part of the imaginary circle 20. In yet another example of an outwardly extending wave spring, the projections extend away from the housing axis and the clad material faces the outside, i.e., away from the housing axis. In another example of the same outwardly extending wave spring, the high tensile strength material faces the outside.

In an example, the base metal 22 having high tensile strength property can include stainless steel, of different grades, heat treated carbon steel. INCONEL® alloys, and HASTELLOY® alloys. INCONEL alloys are understood to include a family of nickel-chromium-based super alloys. HASTELLOY are understood to include a family of nickel based super alloys that include varying percentages of elements such as molybdenum, chromium, cobalt, iron, manganese, etc. In an example, the second conductive clad layer having high conductivity can include copper, copper alloy, aluminum, aluminum alloy, gold, gold alloy, silver, silver alloy, brass, or brass alloy. The combination with a high tensile strength base material and a conductive cladding material is configured to offer high conductivity as well as retain high tensile and high modulus properties at elevated temperatures. The high conductivity layer is preferably positioned on the side of the spring 10 that contacts or faces a pin (not shown). However, in another embodiment, the high tensile strength can contact or face the pin.

Bi-metallic or multi-metallic circular wave springs made from clad materials consist of multiple protrusions on the inner surface (such as FIG. 1A) or the outer surface (such as FIG. 3A, further discussed below) are configured to provide a spring force on a pin inserted therethrough or on an outer cylinder placed thereover for a spring with outward protrusions. Additionally, wave springs provided herein provide high conductivity between the pin and the wave spring and can maintain adequate spring force at elevated temperatures, such as above 150 degrees Celsius, for example 210 degrees Celsius or above. In another aspect of the present assembly and method, a third layer is incorporated. The third layer may be selected to provide corrosion resistance, biocompatibility, variable frictional force, resistance to stress relaxation, ability to operate at extreme temperatures, to provide more or less conductivity, and to provide wear resistance, to name a few. In one specific example, silver is added to the outermost surface of the housing wall, for example, e.g., over the conductive cladding layer or to the high tensile strength base layer.

One embodiment of the present methods comprises a method of forming a multilayered wave spring. The method comprises providing an inner base of a material having a first electrical conductivity. The method further comprises cladding or plating an outer layer of a material having a second electrical conductivity around the base material to form a layer capable of forming a wave spring. In one specific embodiment, the second electrical conductivity is less than the first electrical conductivity. In another example, the second electrical conductivity is more than the first electrical conductivity. In another example, the lower electrical conductivity material has a high tensile strength property than the material with the higher electrical conductivity. The method further comprises forming waves or projections by extending pairs of slits either inwardly in a direction of a housing axis or outwardly away from the axis.

Thus, an aspect of the present invention is a method for providing a conductive circular wave spring having improved spring force at elevated temperatures comprising a body section comprising a first layer having a first conductive property and a first tensile strength property and a second layer having a second conductive property and a second tensile strength property, and wherein the body section comprises at least two slits and a protrusion formed between the two slits and wherein the second conductive property is higher than the first conductive property. In another example, the second layer having the second conductivity faces inwardly in a direction of an axis of the body section.

FIG. 1D shows a cross-section of FIG. 1B taken along line B-B, which shows the clad material consisting of a high modulus base metal 26 (which is configured to face away from a pin or a cylindrical over-housing) and a conductive clad metal surface 28 with a round corner 30.

Figure 1E:
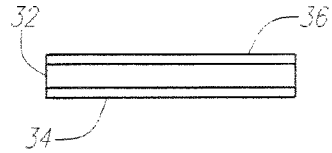
FIG. 1E shows a sectional view of FIG. 1B taken along line B-B, which shows a section of a metal strip as provided in accordance with a third alternative embodiment, which shows the metal strip having two metal flat surfaces clad onto an inner material or layer.

FIG. 1E shows a cross-section of FIG. 1B taken along, line B-B, which shows the clad material consisting of a high modulus metal surface or layer 32 surrounded by a conductive low modulus metal surface or layer but higher conductivity on each side 34, 36 of the high modulus metal layer 32. In other words, the high modulus base layer 32 is sandwiched between two relatively higher conductivity layers 34, 36.

The strength of a higher tensile strength material, such as stainless steel, degrades at much higher temperatures than that of higher conductive but lower tensile strength material, such as copper, making the wave spring effective for conductive applications at higher temperatures as compared to a copper wave spring with no stainless steel layer. The stainless steel layer, even though less conductive than copper and copper alloys, is still electrically conductive so that the stainless steel layer may conduct current through to the copper core layer to maintain effective electrical conductivity in the wave spring. The net result is that the wave spring provides reliable electrical conductivity while lasting longer, being capable of operating at higher temperatures by resisting stress relaxation and/or hot flow, and providing greater corrosion resistance.

Figure 2:
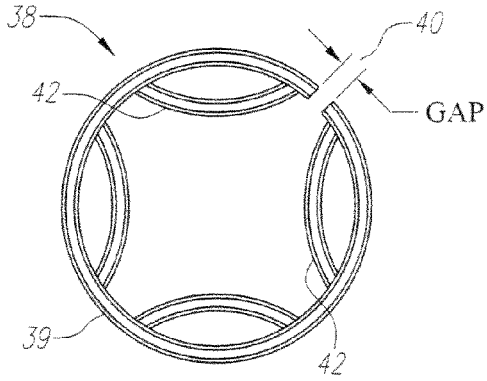
FIG. 2 shows a cross sectional view of a design similar to FIG. 1A with the exception that in this case a longitudinal spring length has been formed into a circular split ring to thereby create or leave a gap.

FIG. 2 shows a cross sectional view of a circular formed strip wave spring 38, similar to that in FIG. 1 with the exception that it is circularly formed from a strip of clad material, i.e., multi-metallic layer, and has a gap 40. The gap 40 is defined by two end edges of the strip of clad material. Thus, the wave spring 38 comprises a generally cylindrical housing 39 comprising a plurality of radially extending waves or protrusions 42 and a gap 40. Not shown in this application is a split circular outside protrusion ring with a gap, which is similar in design to the design shown in FIG. 2 with the exception that the protrusions are outwardly extending instead of inwardly extending. The multi-metallic layer may be made in accordance with other embodiments discussed elsewhere herein.

Figure 3A:
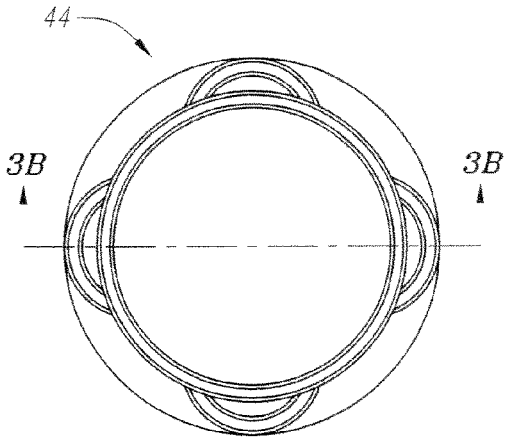
FIG. 3A shows a variation of FIG. 1A with the difference being that the protrusions are radially outwardly extending such that the apex of each protrusion extends outwardly of a nominal outside diameter of the circular metal ring. Although four protrusions are shown, multi-protrusions could be used, including more than or less than four and greater than one.

FIG. 3A shows a cross sectional view of circular wave spring 44 with outwardly extending protrusions 46. The circular spring wave ring 44 is configured to fit into a housing (not shown) and exert an outwardly bias against an interior surface of the housing. The housing (not shown) and the spring wave ring 44 are configured to connect to respective nodes or electrical sources in known manners, such as by way of cables and the like.

Figure 3B:
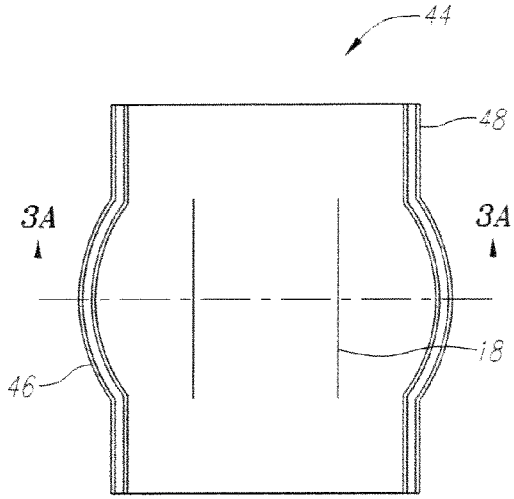
FIG. 3B is a cross-sectional side view of the wave spring of FIG. 3A taken along line D-D.

FIG. 3B shows a sectional view of the circular spring wave ring 44 of FIG. 3A taken along line D-D, which clearly shows the outwardly extending protrusions 44. In one embodiment, the material or wall of the spring wave ring, 44 is made from a multi-metallic metal layer 48. For example, the layer 48 may be made in accordance with anyone of FIGS. 1C-1E. Furthermore, the relatively higher conductive clad layer may face outwardly away from the axis of the housing or inwardly.

Figure 4:
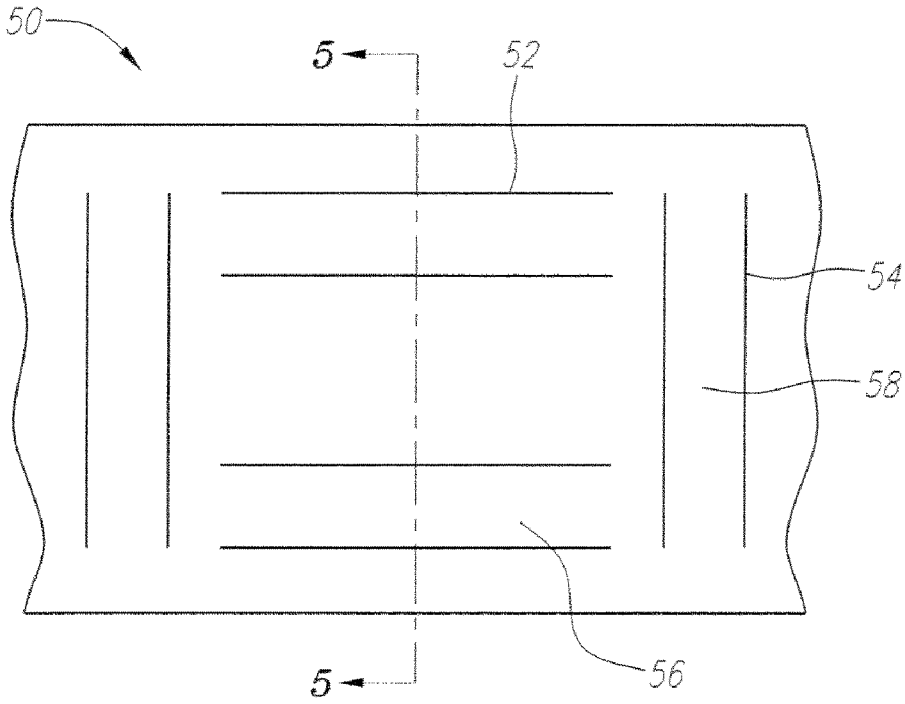
FIG. 4 shows a longitudinal wave spring or axial applications. The longitudinal wave spring for axial applications may be viewed as a wave disc in which protrusions extend above a general area defined by a flange or surface section.

FIG. 4 show a generally linear or plate wave spring 50 with longitudinal wave slits 52 and radial wave slits 54 formed at a 90 degree position of the longitudinal wave slits 52. The different slits, i.e., radial and longitudinal slits, allow the plate wave spring 50 to have protrusions 56, 58 formed that are orthogonal to one another. In other embodiments, the pair of slits are formed at an angle from one another that is not orthogonal.

Figure 5:
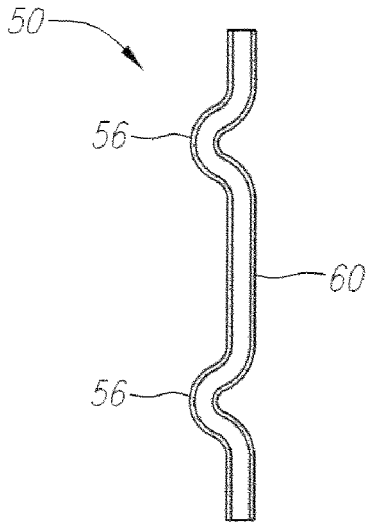
FIG. 5 shows a cross sectional view of FIG. 4 taken along line F-F, i.e., of a longitudinal wave spring.

FIG. 5 shows a cross sectional view of the plate wave spring 50 of FIG. 4 taken along line F-F. The wall layer 60 of the plate wave spring 50 may be made in accordance with anyone of FIGS. 1C-1E. Furthermore, the relatively higher conductive clad layer may face outwardly, in the direction of the apexes of the protrusions 56, or in the opposite direction.

Figure 6:
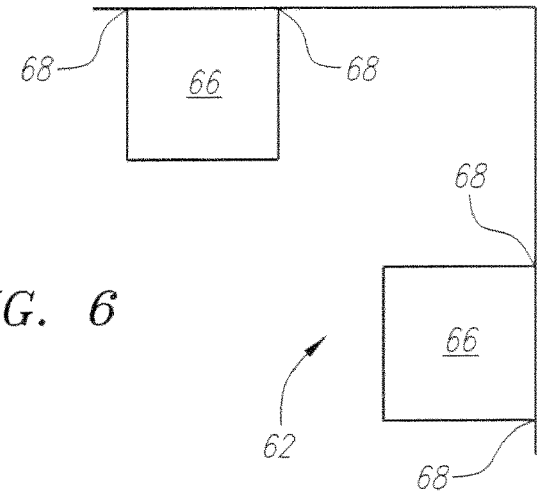
FIGS. 6-8 are schematic end views of wave springs having alternative housing geometries.

FIG. 6 shows a schematic end view of a plate wave spring 62 comprising a multi-metallic L-shape housing 64 comprising two protrusions or waves 66 with fewer than two or more than two contemplated. The wave spring 62 is configured to fit within an outer connector housing or in combination with other structural components to receive a conductive pin or rod. In use, the conductive pin or rod would be inserted in the same orientation as shown, i.e., into the figure. The wave spring 62 may be formed by taking an L-shape bracket and forming pairs of axial slits 68. The pair of slits are then extended inwardly as shown or outwardly to form waves or protrusions 66. The wall layer of the housing 64 may be made in accordance with anyone of FIGS. 1C-1E.

Figure 7:
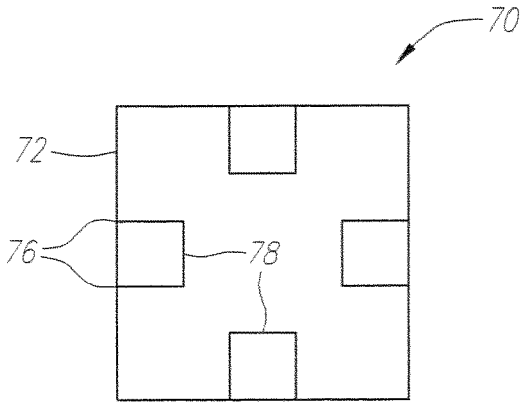

FIG. 7 shows a schematic end view of a square wave spring 70 comprising a multi-metallic square-shape housing 72 comprising four protrusions or waves 74 with fewer than four or more than four contemplated. The wave spring 70 is configured to receive a conductive pin or rod. In use, the conductive pin or rod would be inserted in the same orientation as shown, i.e., into the figure. The wave spring 70 may be formed by taking an square shape bracket and forming pairs of axial slits 76. The pair of slits are then extended inwardly as shown or outwardly to form waves or protrusions 78. The wall layer of the housing 72 may be made in accordance with anyone of FIGS. 1C-1E. In other embodiments, the shape of the housing could be rectangular, oval, diamond, and polygon.

Figure 8:
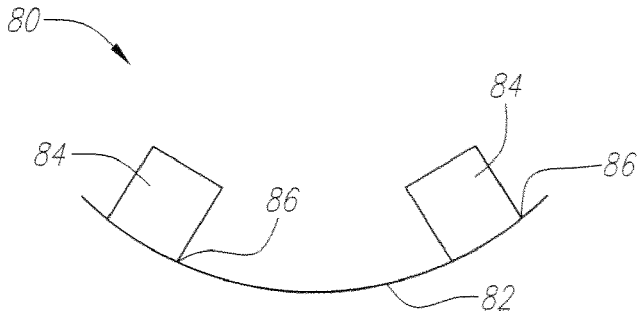

FIG. 8 shows a schematic end view of a plate wave spring 80 comprising a multi-metallic arcuate shaped housing 82 comprising two protrusions or waves 84 with fewer than two or more than two contemplated. The wave spring 80 is configured to fit within an outer connector housing or in combination with other structural components to receive a conductive pin or rod. In use, the conductive pin or rod would be inserted in the same orientation as shown, i.e., into the figure. The wave spring 80 may be formed by taking an arcuate shaped bracket and forming pairs of axial slits 86. The pair of slits are then extended inwardly as shown or outwardly to form waves or protrusions 84. The wall layer of the housing 82 may be made in accordance with anyone of FIGS. 1C-1E.

Thus, aspects of the present assembly and method are understood to include a bimetallic or multi-metallic circular wave spring made from a bimetallic or multi-metallic material consisting of a high tensile strength metal cladded with an outer layer of highly conductive metal or alloy with protrusions on the center and inner diameter or the outer diameter for providing adequate contact force and conductivity between a pin and housing. This bimetallic or multi-metallic conductor achieves high conductivity at elevated temperatures by maintaining the proper contact force between conducting parts, a feature unobtainable by conductors made from highly conductive metals or alloys alone since such materials tend to lose their tensile properties at elevated temperatures. Features of the present assembly and method also include contacting the high tensile strength material with a pin or housing.

Although limited embodiments of the wave springs and their components have been specifically described and illustrated herein, many modifications and variations will be apparent to those skilled in the art. For example, instead of forming a wave or protrusion from two parallel splits, the two slits may angle slightly so that an imaginary line drawn from each of the two slits will intersect. Furthermore, it is understood and contemplated that features specifically discussed for one wave spring may be adopted for inclusion with another wave spring provided their functions are compatible. Accordingly, it is to be understood that the wave springs and their components constructed according to principles of this invention may be embodied other than as specifically described herein.

What is claimed is:

1. A method for forming a conductive wave spring assembly comprising:

forming a generally planar body section comprising a first layer having a first conductive property and a first tensile strength property and a second layer having a second conductive property and a second tensile strength property, forming a first set of two slits along a first direction and a first protrusion between the first set of two slits;

forming a second set of two slits along a second direction at an angle to the first direction and a second protrusion between the second set of two slits; and wherein the second conductive property is higher than the first conductive property.

2. The method of claim 1, further comprising forming a third set of two slits and deforming a surface layer between the third set of two slits to form a third protrusion.

3. The method of claim 1, wherein the second conductive property extends furthest outwardly on the first protrusion and the second protrusion.

4. The method of claim 1, further comprising forming a third set of two slits along the second direction and third protrusion between the third set of two slits.

5. The method of claim 1, wherein the second layer is made from at least one of copper, copper alloy, aluminum, aluminum alloy, gold, gold alloy, silver, silver alloy, brass, and brass alloy.

6. The method of claim 1, wherein the first layer is made from at least one of stainless steel, carbon steel, INCONEL® alloys, and HASTELLOY® alloys.

7. The method of claim 4, wherein the first set of two slits is located at a first end of the second set of two slits and the third set of two slits is located at a second end of the second set of two slits.

8. The method of claim 1, further comprising a third clad layer formed on the body section.

9. The method of claim 1, wherein the two slits of the first set of two slits are generally parallel to one another.

10. The method of claim 1, wherein the angle is 90 degrees.

11. A wave spring assembly comprising:

a generally planar body section comprising a first layer having a first conductive property and a first tensile strength property and a second layer having a second conductive property and a second tensile strength property, a first set of two slits and a first protrusion located between the first set of two slits formed upon the generally planar body section;

a second set of two slits and a second protrusion located between the second set of two slits formed upon the generally planar body section;

wherein the first set of two slits is formed along a first direction and the second set of two slits is formed along a second direction, which is at an angle to the first direction; and wherein the second conductive property is higher than the first conductive property.

12. The wave spring assembly of claim 11, wherein the angle is 90 degrees.

13. The wave spring assembly of claim 11, further comprising a third set of two slits and a third protrusion located between the third set of two slits formed upon the generally planar body section.

14. The wave spring assembly of claim 12, wherein the second conductive property extends furthest outwardly on the first protrusion and the second protrusion.

15. The wave spring assembly of claim 11, wherein the second layer is made from at least one of copper, copper alloy, aluminum, aluminum alloy, gold, gold alloy, silver, silver alloy, brass, and brass alloy.

16. The wave spring assembly of claim 11, wherein the first layer is made from at least one of stainless steel, carbon steel, INCONEL® alloys, and HASTELLOY® alloys.

17. The wave spring assembly of claim 13, wherein the first set of two slits is located at a first end of the second set of two slits and the third set of two slits is located at a second end of the second set of two slits.

18. The wave spring assembly of claim 11, further comprising a third clad layer formed upon the body section.

19. The wave spring assembly of claim 11, wherein the two slits of the first set of two slits are generally parallel to one another.

20. The wave spring assembly of claim 11, wherein the angle is 90 degrees.

* * * * *

UNITED STATES PATENT AND TRADEMARK OFFICE

CERTIFICATE OF CORRECTION

PATENT NO. : 7,985,105 B2
APPLICATION NO. : 12/770558
DATED : July 26, 2011
INVENTOR(S) : Pete Balsells It is certified that error appears in the above-identified patent and that said Letters Patent is hereby corrected as shown below:

In column 3, line 3, delete “or” and insert -- for --, therefor.

In column 4, line 49, delete “steel.” and insert -- steel, --, therefor.

In column 5, line 51, delete “along,” and insert -- along --, therefor.

In column 6, line 30, delete “ring,” and insert -- ring --, therefor.

Signed and Sealed this
Tenth Day of April, 2012

David J. Kappos

David J. Kappos
*Director of the United States Patent and Trademark Office*